United States Patent [19]

Lifka et al.

[11] Patent Number: 4,629,517

[45] Date of Patent: Dec. 16, 1986

[54] HIGH STRENGTH AND CORROSION RESISTANT ALUMINUM ARTICLE AND METHOD

[75] Inventors: Bernard W. Lifka, New Kensington; William G. Truckner, Avonmore; Ralph W. Rogers, Jr., New Kensington, all of Pa.

[73] Assignee: Aluminum Company of America, Pittsburgh, Pa.

[21] Appl. No.: 631,482

[22] Filed: Jul. 16, 1984

Related U.S. Application Data

[63] Continuation-in-part of Ser. No. 453,480, Dec. 27, 1982, abandoned.

[51] Int. Cl.[4] ..... C22F 1/04

[52] U.S. Cl. ..... 148/12.7 A; 148/415; 148/417

[58] Field of Search ..... 148/12.7 A, 415, 417, 148/439, 440, 2

[56] References Cited

U.S. PATENT DOCUMENTS 3,762,916 10/1973 Kirman ..... 148/12.7 A

*Primary Examiner*—R. Dean

*Attorney, Agent, or Firm*—Andrew Alexander; John P. Taylor

[57] ABSTRACT

A shaped aluminum article is disclosed characterized by a yield strength of over 414 MPa (60 ksi) and good corrosion resistance when aged to a T76 temper. The article is formed from an aluminum base alloy having good formability in an annealed state, and sufficiently low quench sensitivity to permit air quenching. The alloy consists essentially of: 6.5. to 7.5 wt. % zinc, 2.4 to 3.0 wt. % magnesium, 0.0 to 0.8 wt. % copper, and 0.01 to 0.18 wt. % zirconium, with the following maximum amounts of other alloying ingredients or impurities: 0.2 wt. % silicon, 0.4 wt. % iron, 0.1 wt. % manganese, 0.05 wt. % chromium, 0.06 wt. % titanium, and 0.05 wt. % maximum each other alloying ingredient or impurity with a total maximum of 0.15 wt. %, the balance consisting of aluminum.

16 Claims, 4 Drawing Figures

EFFECT OF Zn AND Mg CONTENT ON YIELD STRENGTH-T63 TEMPER

EFFECT OF Zn AND Mg CONTENT ON
EXCO TEST EXFOLIATION PERFORMANCE

HIGH STRENGTH AND CORROSION RESISTANT ALUMINUM ARTICLE AND METHOD

CROSS-REFERENCE TO RELATED APPLICATIONS

This application is a continuation-in-part of application Ser. No. 453,480 filed Dec. 27, 1982 and now abandoned.

BACKGROUND OF THE INVENTION

1. Technical Field of the Invention

This invention relates to a shaped aluminum article. More particularly, this invention relates to an aluminum article exhibiting high strength and good corrosion resistance produced from a zinc-magnesium type aluminum base alloy.

2. Description of the Prior Art

In recent years, due to increased interest in conservation and recycling of materials, new uses for aluminum have been proposed due to its light weight and reusability. This has become of particular interest in applications, such as the automobile industry where weight reduction can result in fuel conservation. It is desirable that the aluminum replacement, however, be able to match the strength and corrosion resistance of the metal which it is replacing. It is also desirable that the fabrication of the part should be economically competitive with current fabricating techniques used on the materials being replaced.

For example, aluminum has been used as a replacement for steel in automobile bumpers. This requires the use of an alloy which can provide sufficient strength to resist at least the minimum impact of another vehicle, meet corrosion resistance requirements, including both resistance to exfoliation and stress-corrosion cracking, and have good forming or fabrication characteristics.

Aluminum Association 7000 series alloys, which usually contain as the principal ingredients zinc, magnesium, and copper, characteristically combine high strength with resistance to corrosion. However, as requirements increase for aluminum as a replacement for other materials, there remains a need for an aluminum base alloy with strength exceeding the strength of present aluminum alloys while maintaining at least equal corrosion resistant characteristics. While other 7000 series alloys have been proposed as replacements for those currently in use, usually an increase in strength is gained at the expense of reduced resistance to exfoliation or an increased quench sensitivity necessitating the use of water quenching which can result in distortion of the shaped aluminum article made from the alloy, e.g., an aluminum bumper for an automobile. cause distortion of the article made from the alloy, e.g., an automobile bumper for an automobile.

Kawatsu U.S. Pat. No. 3,531,337 discloses an aluminum base alloy containing, as principal additives, 2.6 wt. % zinc and 0.6 to 3.8 wt. % magnesium. In addition to other well known alloying components such as iron, manganese, chromium, zirconium, and silicon, the patentee adds from 0.2 to 1.2 wt. % nickel and/or cobalt and then subjects the alloy to a nitriding process to work harden the product. The addition of at least one of these two metals, together with iron, is said to concentrate around crystalline grain boundary and strengthen the neighborhood of grain boundary by increasing the dislocation density and promote the work hardening.

However, there remains a need for an aluminum base alloy capable of being formed into a shaped article having a yield strength of at least 414MPa (60 ksi) and having satisfactory resistance to both stress-corrosion cracking and exfoliation. Furthermore, the alloy must have sufficiently low quench sensitivity to permit air quenching after heat treatment so that the article formed from the alloy will not be distorted during quenching.

SUMMARY OF THE INVENTION

It is therefore an object of this invention to provide an article suitable for use in the automobile industry from an aluminum base alloy capable of being overaged to a yield strength of at least 414 MPa (60 ksi) while maintaining satisfactory resistance to corrosion.

It is another object of this invention to provide a high strength article from an aluminum base alloy characterized by both resistance to exfoliation and to stress-corrosion cracking after aging.

It is yet another object of this invention to provide an article constructed using a high strength aluminum base alloy having good formability in an annealed temper.

It is a further object of this invention to provide a shaped article from an aluminum base alloy having reduced quench sensitivity whereby the shaped article, after heat treatment, may be air quenched to minimize the possibility of distortion of the shaped article during quenching.

These and other objects of the invention will be apparent from the description and drawings.

In accordance with the invention, a shaped aluminum article is constructed from an aluminum base alloy characterized by a yield strength of over 414 MPa 60 ksi) and good corrosion resistance when aged to a T76 temper, good formability in an annealed state, and sufficiently low quench sensitivity to permit air quenching. The alloy consists essentially of: 6.5. to 7.5 wt. % zinc, 2.4 to 3.0 wt. % magnesium, 0.0 to 0.8 wt. % copper, and 0.01 to 0.18 wt. % zirconium, with the following maximum amounts of other alloying ingredients or impurities: 0.2 wt. % silicon, 0.4 wt. % iron, 0.1 wt/% manganese, 0.05 wt. % chromium, 0.06 wt. % titanium, and 0.05 wt. % maximum each other alloying ingredient or impurity with a total maximum of 0.15 wt. %, the balance consisting of aluminum.

DESCRIPTION OF THE INVENTION

Figure 1:
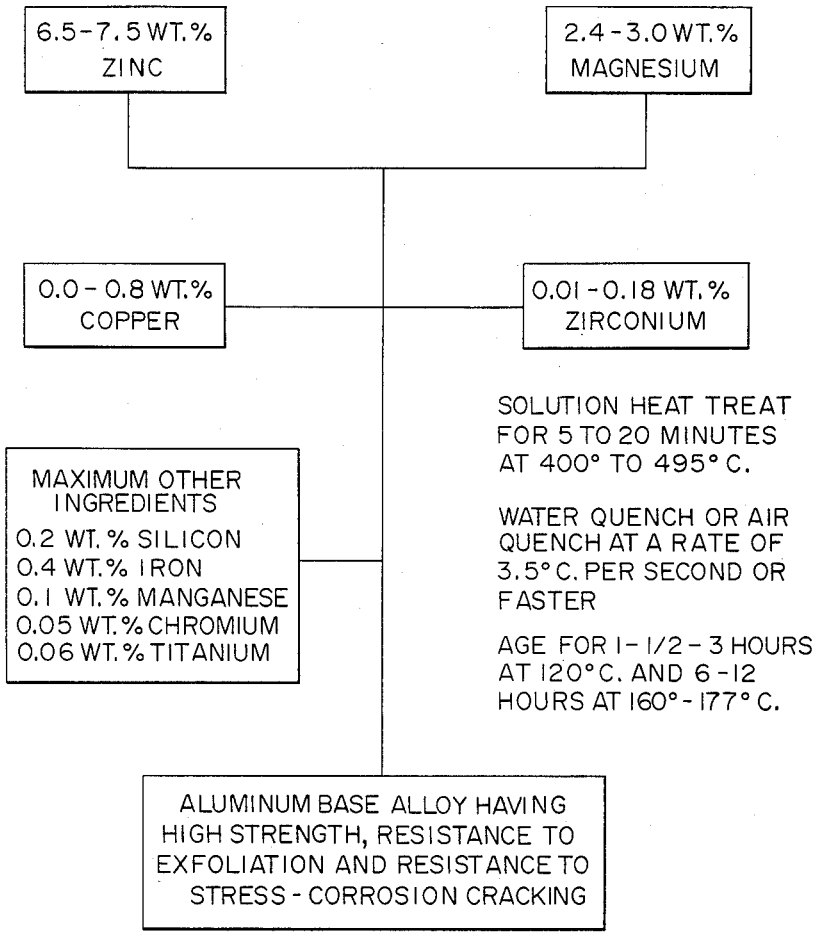
FIG. 1 is a flow sheet illustrating the invention.

In accordance with the invention, a shaped article is provided from an aluminum base alloy which is characterized by good formability in an annealed temper, low sensitivity to quenching to permit air quenching to reduce the possibility of distortion in the article during quenching, and sufficient strength to permit overaging to a T76 temper to provide sufficient resistance to both stress-corrosion cracking and exfoliation while maintaining a transverse yield strength of at least 414 MPa (60 ksi).

The alloy used in forming the shaped article contains, as principal ingredients, from 6.5 to 7.5 wt. % zinc, from 2.4 to 3.0 wt. % magnesium, from 0.0 to 0.8 wt. % copper, and from 0.01 to 0.18 wt. % zirconium. The alloy, thus, generally falls in the 7000 series of aluminum base alloys as defined by the Aluminum Association.

The copper content of the aluminum base alloy may vary from 0.0 to 0.8 wt. %. The copper content can contribute to the strength of the alloy, including impact resistance, but may adversely effect the resistance to exfoliation. Furthermore, it has been found that higher levels of copper benefit strength in this alloy only with rapid quenching, such as is attainable with a water quench. Since the use of this alloy is intended to be to form an article which will be air quenched after solution heat treatment, the amount of copper is preferable maintained at 0.6 wt. % of less amd most preferably at less than 0.4 wt. %.

The chromium content is maintained at 0.05 wt. % or less to aid in lowering the quench sensitivity level of the alloy to permit air quenching which, as stated above, is preferred for the formed article of the invention in contrast to more rapid water quenching which may distort the shaped article.

The maximum amount of other alloying metals and/or impurities in the alloy should not exceed 0.2 wt. % silicon, 0.4 wt. % iron, 0.1 wt. % manganese, and 0.6 wt. % titanium. Other alloying ingredients and/or impurities should not exceed an individual maximum of 0.05 wt. % with a total maximum of 0.15 wt. %. The balance of the alloy consists essentially of aluminum.

As previously discussed, the alloy is designed for applications requiring high strength such as, for example, in automobile bumpers or other articles produced from sheet by multiple forming operations such as stamping, drawing, and the like. The high zinc and magnesium content, together with low copper, manganese, and chromium content, provides an enhanced combination of excellent annealed (o) temper formability, low quench sensitivity permitting air quenching to minimize part distortion, and high strength and good corrosion resistance in the final temper resulting in a better combination of such properties than found in the present commercial 7000 series alloys.

In particular, the combination of high strength and good corrosion resistance is due to the particularly high strength which this alloy is capable of achieving when aged to peak strength at a T63 temper as shown in the graph in FIG. 2 which will be explained in example I below. This high strength permits the alloy to be overaged to a T76 temper which increases its resistance to corrosion, particularly to exfoliation. The overaging results in some loss of strength (from peak strength at T63 temper). However, due to its superior strength, the alloy still provides a transverse yield strength of over 414 MPa (60 ksi) when overaged to T76 temper which is still well above the strength exhibited by prior art 7000 series alloys when aged to their peak strength T63 temper.

The alloy may be produced in sheet form in an annealed (o) temper to facilitate fabricating. After forming into the desired shape, the shaped article is heat treated, quenched, and aged to develop the desired strength and corrosion resistance. The solution heat treatment may be accomplished by a 5 to 20 minute, preferably about 10 minute, soak at temperatures of from 400° to 495° C. (750 to 930° F.), preferably from 425° to 480° C. (800° to 900° F.). Higher temperatures are not recommended as they can cause recrystallization. Most preferably, the heat treatment is carried out at 460° C.±10° C. (860° F.±18° F.) for maximum strength with minimum distortion.

The heat treated article is then quenched at a rate sufficiently fast to prevent impairment of either strength or resistance to exfoliation. The aluminum base alloy used to form the shaped article is capable of achieving a 414 MPa (60 ksi) minimum yield strength (upon subsequent aging to a T76 temper) with forced air quenching provided the average quenching rate down to 260° C. (500° F.) is 3.5° C. (6.3° F.) per second or faster. Preferably, the quenching rate is about 5° C. (9° F.) per second down to 260° C. (500° F.). Quenching rates slower than 3.5° C. may impair both strength and resistance to exfoliation. It will be understood, of course, that faster quenching, such as water quenching, may be used if the particular article to be fabricated from the alloy is of a size or shape where the possibility of distortion will not present a problem.

In some instances, the use of spray quench equipment and properly designed support racks may be sufficient to minimize distortion. There is no significant effect of a faster quench on resistance to corrosion.

The heat treated and quenched article must be aged to a T76 temper to develop the desired high strength and corrosion resistant characteristics. This aging may be carried out by soaking the article for 1½ to 3 hours, preferably about 2 hours, at a metal temperature of about 120° C. (250° F.) plus about 6 to 12 hours, preferably about 8 hours, at a metal temperature of from 160° C. (320° F.) to 177° C. (350° F.). Variations in temperature at either stage of about ±6° C. (10° F.) are permitted. Alternatively, the second aging step may be shortened to about 4 hours by increasing the aging temperature (of the metal) to about 177° C. (350° F.). However, closer control of the temperature to about ±3° C. (±5° F.) is recommended to achieve the same results.

To further illustrate the invention, tests were run to respectively demonstrate the strength, formability, impact resistance, and resistance to corrosion of the shaped article made using the described alloy.

EXAMPLE I

A number of sample sheets formed in ranges covered by the alloy of the invention and three other 7000 series high Zn-Mg aluminum alloys were solution heat treated for 15 minutes at 468° C., cooled by forced air quenching at a rate of 5° C. per second and then aged to a T63 temper by aging the samples for 3 hours at 148° C. The compositions of the samples are listed in Table 1.

TABLE 1

| | Registered Limits - Wt. % - Remainder is Aluminum | | | | | | | | | | |
|---|---|---|---|---|---|---|---|---|---|---|---|
| | | | | | | | | | | Others | |
| Alloy | Si | Fe | Cu | Mn | Mg | Cr | Zn | Zr | Ti | Each | Total |
| 7046-T63 | 0.20 | 0.40 | 0.25 | 0.30 | 1.0–1.6 | 0.20 | 6.6–7.6 | 0.10–0.18 | 0.06 | 0.05 | 0.15 |
| 7106-T63 | Si + Fe = | 0.35 | 0.10 | 0.25 | 1.7–2.8 | 0.06–0.2 | 3.7–4.8 | 0.08–0.25 | 0.01–0.06 | 0.05 | 0.15 |

TABLE 1-continued

| | Registered Limits - Wt. % - Remainder is Aluminum | | | | | | | | | | |
|---|---|---|---|---|---|---|---|---|---|---|---|
| | | | | | | | | | | Others | |
| Alloy | Si | Fe | Cu | Mn | Mg | Cr | Zn | Zr | Ti | Each | Total |
| 7021-T63 | 0.25 | 0.40 | 0.25 | 0.10 | 1.2–1.8 | 0.05 | 5.0–6.0 | 0.08–0.18 | 0.10 | 0.05 | 0.15 |
| Alloy of Invention | 0.20 | 0.40 | 0.0–0.8 | 0.10 | 2.4–3.0 | 0.05 | 6.5–7.5 | 0.08–0.18 | 0.06 | 0.05 | 0.15 |

TABLE 2

| | Remelt Composition - Wt % | | | | | | | | | | |
|---|---|---|---|---|---|---|---|---|---|---|---|
| | | | | | | | | | | Others | |
| Sheet Gauge (in.) | Si | Fe | Cu | Mn | Mg | Cr | Zn | Zr | Ti | Each | Total |
| 0.100 | 0.07 | 0.26 | 0.02 | 0.00 | 2.52 | 0.00 | 7.35 | 0.13 | 0.02 | 0.05 | 0.15 |
| 0.160 | 0.07 | 0.27 | 0.02 | 0.00 | 2.63 | 0.00 | 7.32 | 0.13 | 0.02 | 0.05 | 0.15 |

TABLE 3

| | Registered Limits - Wt. % - Remainder is Aluminum | | | | | | | | | | |
|---|---|---|---|---|---|---|---|---|---|---|---|
| | | | | | | | | | | Others | |
| Alloy | Si | Fe | Cu | Mn | Mg | Cr | Zn | Zr | Ti | Each | Total |
| 7046-T63 | 0.20 | 0.40 | 0.25 | 0.30 | 1.0–1.6 | 0.20 | 6.6–7.6 | 0.10–0.18 | 0.06 | 0.05 | 0.15 |
| 7146-T63 | 0.20 | 0.40 | — | — | 1.0–1.6 | — | 6.6–7.6 | 0.10–0.18 | 0.06 | 0.05 | 0.15 |
| 7021-T63 | 0.25 | 0.40 | 0.25 | 0.10 | 1.2–1.8 | 0.05 | 5.0–6.0 | 0.08–0.18 | 0.10 | 0.05 | 0.15 |

Figure 2:
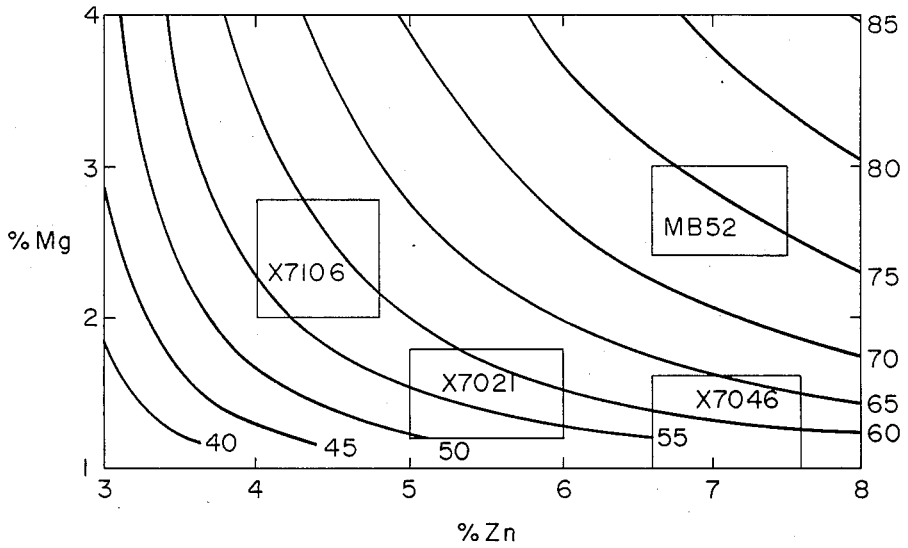
FIG. 2 is a graph showing the effect of zinc and magnesium content on yield strengths of various 7000 series alloys aged to a T63 temper.

As shown in FIG. 2 the transverse yield strength for samples formulated within the limits for the alloy of the invention resulted in much superior yield strengths when aged to a T63 temper. This temper indicates peak strength aging for 7000 series alloys which have been forced air quenched.

Figure 3:
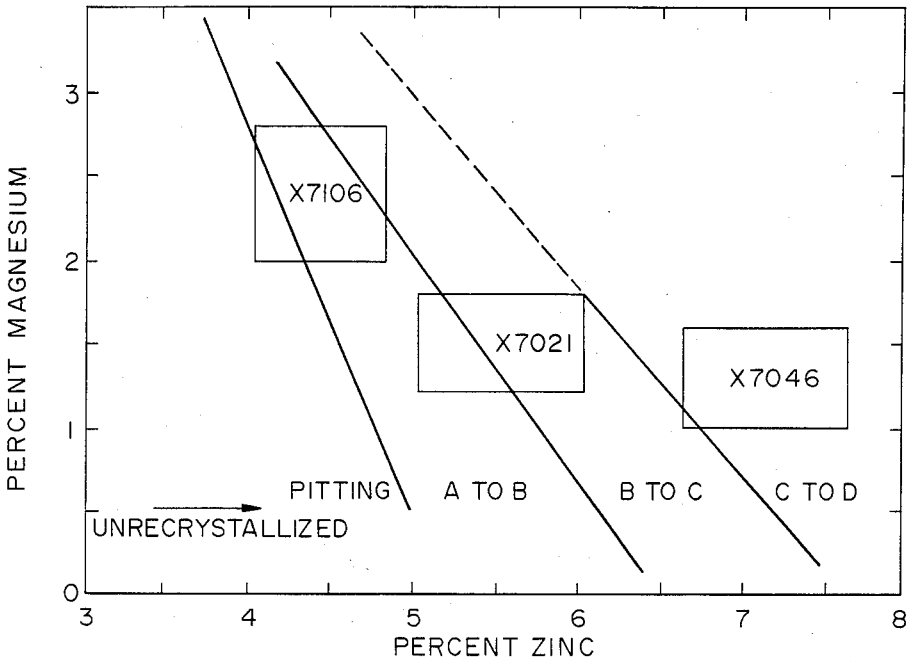
FIG. 3 is a graph showing the effect of zinc and magnesium content on the exfoliation properties of prior art 7000 series alloys aged to a T63 temper.

When the three above alloys, representing the prior art, were tested for resistance to exfoliation, the results were as shown in FIG. 3. While samples of the alloy of the invention (aged to a T63 temper) were not tested for exfoliation resistance, it would be expected that the results would be similar to that of the X7046 alloy samples in view of the zinc and magnesium content of the alloy of the invention (i.e., a poor resistance to exfoliation).

However, since the alloy of the invention possesses markedly superior yield strength to the other alloy samples at the T63 temper, it is possible to overage samples made from the alloy of the invention to increase the resistance to exfoliation. The resultant loss in yield strength (due to such overaging) can be tolerated—unlike the other alloys—because of its initially superior strength. To demonstrate this, samples made from the alloy of the invention were formed in 0.100 and 0.160" thicknesses having the compositions as shown in Table 2.

The samples were solution heat treated for 15 minutes at 468° C., forced air quenched at 5° C. per second and then aged to a T76 temper by aging for 2 hours at 121° C. followed by 8 hours at 160° C. The transverse yield strengths for these samples were then measured and found to be respectively 445 Mpa (64.6 ksi) for the 0.100" sheet and 443 MPa (64.3 ksi) for the 0.160" sheet. It is seen that the overaging of these samples to a T76 temper still results in a superior transverse yield strength as compared to the results shown in FIG. 2 for the prior art 7000 series samples aged to give maximum transverse yield strength at a T63 temper.

EXAMPLE II

To demonstrate that the overaging of samples made using the alloy of the invention results in resistance to exfoliation at least equal to prior art 7000 series alloys, samples made using the alloy of the invention and three prior art 7000 series alloys were tested for resistance to exfoliation. The composition of the samples are tabulated in Table 3.

The samples from the three prior art alloys, identified in Table 3, were each aged to a T63 temper (as previously described) while the samples made from the alloy of the invention were aged (as previously described) to a T76 temper. The results of the exfoliation tests are listed in Table 4.

TABLE 4

| | EXCO - 48 Hours | | SWAAT - 5 Days | |
|---|---|---|---|---|
| Alloy | Rating | Wt. Loss, mg/cm$^2$ | Rating | Wt. Loss, mg/cm$^2$ |
| Alloy of Invention | EA | 23.9 | p[1] | 3.1 |
| X7046-T63 | ED | 107.9 | ED | 107.5 |
| X7146-T63 | EA | 26.3 | EA | 7.8 |
| X7021-T63 | EA | 22.7 | EB | 11.0 |

NOTE:
[1]Only superficial pitting corrosion, no exfoliation corrosion

EXAMPLE III

Further comparative tests were conducted to demonstrate the resistance to stress corrosion cracking of samples made from the alloy of the invention and two other 7000 series alloys. Samples 1–7 represent the invention although, as shown in Table 5, the composition of samples 1–4 differed slightly in the Cu, Mn, Zn, and Zr content from that of samples 5–7. The compositions of all of the samples are listed in Table 5.

The samples were evaluated for stress-corrosion cracking (SCC) resistance by transverse, stress beam assemblies exposed at stress levels of 75, 50, and 25% yield strength for seven days in boiling 6% NaCl. The results, as shown in Table 6, show resistance to SCC by all of the samples made using the alloy of the invention up to 50% yield strength and for some of the samples up to 75% yield strength. In comparison, the X7146-T63 samples all tested satisfactorily at 75% yield strength while one of the X7029-T63 samples failed at 25% yield strength and the other at 50% yield strength.

TABLE 5

| | Aluminum Association Registered Limits in Wt. % - Remainder is Aluminum | | | | | | | | | | | |
|---|---|---|---|---|---|---|---|---|---|---|---|---|
| | | | | | | | | | | | Others | |
| Sample | Si | Fe | Cu | Mn | Mg | Cr | Zn | V | Zr | Ti | Each | Total |
| 1–4 | 0.08 | 0.29 | 0.20 | 0.03 | 2.5 | 0.03 | 7.1 | — | 0.12 | 0.06 | 0.05 | 0.15 |
| 5–7 | 0.08 | 0.29 | 0.27 | 0.10 | 2.5 | 0.03 | 7.2 | — | 0.02 | 0.06 | 0.05 | 0.15 |
| X7146-T63 | 0.20 | 0.40 | — | — | 1.0–1.6 | — | 6.6–7.6 | — | 0.10–0.18 | 0.06 | 0.05 | 0.15 |
| X7029-T63 | 0.10 | 0.12 | 0.50–0.9 | 0.03 | 1.3–2.0 | — | 4.2–5.2 | 0.05 | — | 0.05 | 0.03 | 0.10 |

TABLE 6

| | Yield Strength | | | | | | | | |
|---|---|---|---|---|---|---|---|---|---|
| | Stressed 75% | | | Stressed 50% | | | Stressed 25% | | |
| Sample | Stress (ksi) | F/N | Time - Hrs. | Stress (ksi) | F/N | Time - Hrs. | Stress (ksi) | F/N | Time - Hrs. |
| 1 | 47.0 | 0/3 | OK 168 | 31.3 | 0/3 | OK 168 | 15.7 | 0/3 | OK 168 |
| 2 | 39.7 | 0/3 | OK 168 | 26.5 | 0/3 | OK 168 | 13.2 | 0/3 | OK 168 |
| 3 | 43.9 | 3/3 | 6, 22, 28 | 29.3 | 0/3 | OK 168 | 14.6 | 0/3 | OK 168 |
| 4 | 38.9 | 3/3 | 6, 22, 72 | 26.0 | 0/3 | OK 168 | 13.0 | 0/3 | OK 168 |
| 5 | 52.0 | 3/3 | 4, 6, 22 | 34.7 | 0/3 | OK 168 | 17.3 | 0/3 | OK 168 |
| 6 | 44.7 | 3/3 | 4, 6, 6 | 29.8 | 0/3 | OK 168 | 14.9 | 0/3 | OK 168 |
| 7 | 38.3 | 2/3 | 54, 168 OK 168 | 25.6 | 0/3 | OK 168 | 12.8 | 0/3 | OK 168 |
| X7146-T63 | 45.0 | 0/2 | OK 168 | 30.0 | 0/2 | OK 168 | — | — | — |
| X7029-T63 | — | — | — | 30.0 | 2/2 | 6, 22 | 15 | 1/2 | 96, OK 168 |

EXAMPLE IV

Figure 4:
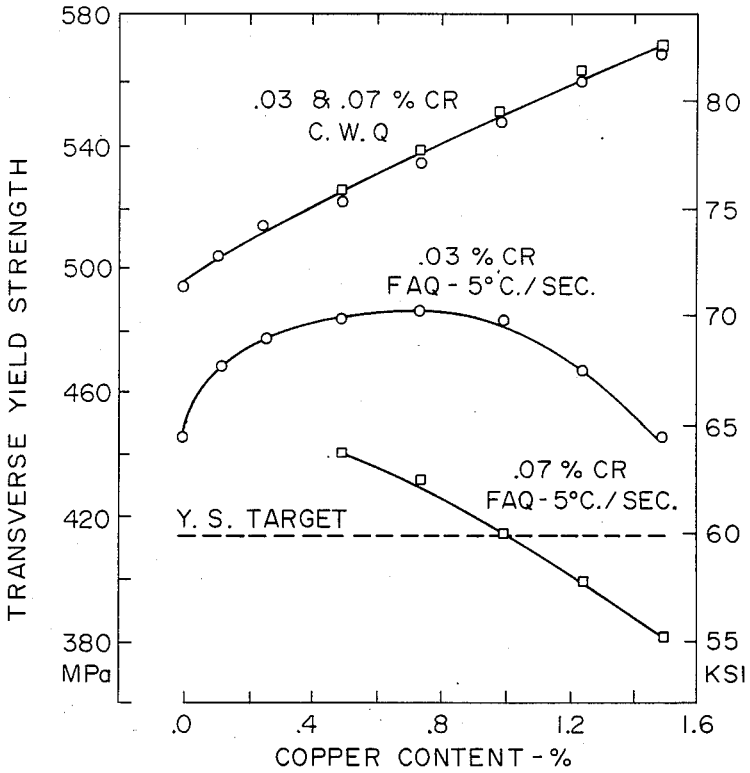
FIG. 4 is a graph depicting the effect of chromium and copper content on transverse yield strength.

To illustrate the effects of the presence of copper and/or chromium both with forced air quenching and water quenching, a series of samples were prepared containing 7.4 wt. % zinc, 2.7 wt. % magnesium, and 0.3 wt. % manganese with copper amounts from 0.0 to 1.5 wt. % and chromium amounts of from 0.03 to 0.07 wt. %. Each sample was solution heat treated at 460° F. for 10 minutes and then quenched in either air or water (as indicated in FIG. 4) followed by aging for 2 hours at 120° C. followed by a second aging step for 8 hours at 160° C. The samples were then tested for transverse yield strength. The results, as illustrated in FIG. 4, show that for a forced air quench (FAQ) of 5° C. per second, the amount of copper should be 0.8 wt. % or less to develop the desired yield strength. Furthermore, the results also illustrate the effect of the chromium level on quench sensitivity for the forced air quenches.

EXAMPLE V

To demonstrate the formability in annealed (o) temper of the alloy used in forming the shaped article of the invention, a series of samples containing 7.1 wt. % zinc, 2.5 wt. % magnesium, 0.20 wt. % copper, 0.12 wt. % chromium, 0.29 wt. % iron, 0.08 wt. % silicon, and 0.03 wt. % manganese were evaluated at various gauges to determine the annealed (o) temper mechanical properties of the alloy used in forming the article of the invention versus conventional 7000 series alloys to compare the formability of the alloys. Sample A in each gauge represents the novel alloy used in the invention. Sample B is Aluminum Association (AA) alloy 7021. Sample C is (AA) 7146 and sample D is (AA) 7046. The compositions of each of these prior art alloys are listed in table 3. Table 7 lists comparative tensile and yield strengths, elongation, percent reduction of area, plastic strain ratio (r) values, and strain hardening exponent (n) values. Table 8 indicates the results of a hemispherical stretch test on a 4 inch diameter hemisphere of each sample at the indicated gauges. Table 9 shows the results of 1.57 radian (90°) minimum bend tests for each alloy at various gauges. In each instance, no orange peel was noted on any of the tested samples. The results generally indicate that the alloy of the invention has annealed (o) temper forming characteristics comparable or superior to the conventional alloys.

TABLE 7

| | | SUMMARY OF MECHANICAL PROPERTIES | | | | | | | | | | | | | |
|---|---|---|---|---|---|---|---|---|---|---|---|---|---|---|---|
| | | Strength (MPa) | | | | Elongation (%) Gauge Length | | | | Percent Reduction of Area | | Plastic Strain Ratio | | Strain Hardening Exponent | |
| | Gauge | Tensile | | Yield | | 5.08 mm | | 2.54 mm | | | | | | | |
| Sample | mm | L | T | L | T | L | T | L | T | L | T | L | T | L | T |
| A | 2.54 | 218 | 221 | 171* | 172 | 13.8 | 13.0 | 43.8 | 42.5 | 50 | 45 | .323 | .388 | .149 | .152 |
| B | 2.54 | 198 | 200 | 158 | 162 | 15.1 | 15.8 | 44.0 | 42.0 | 43 | 50 | .474 | .953 | .105 | .118 |
| C | 2.67 | 177 | 181 | 135 | 140 | 18.5 | 22.0 | — | — | — | — | .589 | 1.086 | .122 | .124 |
| D | 2.54 | 206 | 216 | 172 | 180 | 15.0 | 16.5 | 90 | — | — | — | — | — | — | — |
| A | 3.81 | 212 | 217 | 160 | 161 | 19.5 | 18.5 | 63.8 | 69.3 | 56 | 58 | .318 | .536 | .155 | .157 |
| B | 3.86 | 192 | 195 | 141 | 149 | 17.2 | 18.3 | 49.5 | 83.5 | — | 52 | .459 | .899 | .131 | .132 |
| D | 3.68 | 189 | 190 | 144 | 147 | 16.0 | 15.0 | — | — | — | — | — | — | — | — |
| A | 5.08 | 218 | 222 | 163 | 164 | 16.8 | 15.5 | 68.7 | 79.8 | 40 | 46 | .346 | .670 | .157 | .160 |
| B | 4.78 | 191 | 189 | 140 | 145 | 17.8 | 18.6 | 60.3 | 88.5 | 46 | 52 | .448 | .870 | .132 | .132 |
| C | 4.88 | 181 | 187 | 130 | 139 | 21 | 20.5 | — | — | — | — | .540 | 1.20 | .137 | .134 |

TABLE 7-continued

| SUMMARY OF MECHANICAL PROPERTIES | | | | | | | | | | | | | | | |
|---|---|---|---|---|---|---|---|---|---|---|---|---|---|---|---|
| | | Strength (MPa) | | | | Elongation (%) Gauge Length | | | | Percent Reduction | | Plastic Strain | | Strain Hardening | |
| | Gauge | Tensile | | Yield | | 5.08 mm | | 2.54 mm | | of Area | | Ratio | | Exponent | |
| Sample | mm | L | T | L | T | L | T | L | T | L | T | L | T | L | T |
| D | 4.32 | 194 | 199 | 141 | 148 | 22 | 20 | — | — | — | — | — | — | — | — |

NOTES:
L = Longitudinal
T = Transverse
*Broke near end of gauge length

TABLE 8

| SUMMARY OF 10.2 CM DIAMETER HEMISPHERICAL STRETCH TESTS | | | | | | | | | |
|---|---|---|---|---|---|---|---|---|---|
| | | | | | | Strain at Necking (%) | | | |
| | Gauge | Punch Load (Kn) | | Punch Travel* (cm) | | D | | L | |
| Sample | mm | D | L | D | L | Major | Minor | Major | Minor |
| A | 2.82 | 86.3 | 86.3 | 3.14 | 3.56 | 48 | 10 | 53 | 40 |
| B | 2.54 | 59.6 | 60.5 | 2.39 | 2.62 | 36 | 8 | 42 | 28 |
| C | 2.67 | 54.3 | 56.9 | 2.54 | 2.70 | 46 | 14 | 49 | 34 |
| D | 2.54 | 64.9 | 67.6 | 2.36 | 2.72 | 39 | 15 | 56 | 41 |
| A | 3.83 | 112.1 | 118.3 | 3.12 | 3.64 | 54 | 8 | 60 | 45 |
| B | 3.86 | 105.0 | 102.3 | 2.84 | 3.12 | 45 | 10 | 49 | 33 |
| D | 3.68 | 100.5 | 104.1 | 2.73 | 3.31 | 45 | 12 | 60 | 45 |
| A | 5.08 | 161.9 | 168.1 | 3.24 | 3.87 | 52 | 12 | 67 | 40 |
| B | 4.78 | 157.0 | 132.6 | 2.90 | 3.10 | 48 | 10 | 53 | 32 |
| C | 4.88 | 160.1 | 143.2 | 3.40 | 3.56 | 66 | 15 | 65 | 40 |
| D | 4.32 | 126.3 | 130.8 | 2.99 | 3.41 | 50 | 20 | 65 | 50 |

NOTES:
D = Dry
L = Lubricated
*Stretch tests run only with 30.5 cm square samples

TABLE 9

| SUMMARY OF 1.57 RADIAN (90°) MINIMUM BEND TESTS ACTUAL AND PREDICTED | | | | | | | | | |
|---|---|---|---|---|---|---|---|---|---|
| | | 1.57 Radian (90°) Minimum Bend Radius* | | | Springback | | | | Degree |
| | Gauge | | Predicted | | Actual | | Predicted | | of Orange |
| Sample | mm | Actual | A | B | Radians | (Degrees) | Radians | (Degrees) | Peel |
| A | 2.82 | 1.1 t | 1.3 t | 1.9 t | .05 | (3) | .03 | (2.1) | None |
| B | 2.62 | 1.9 t | — | — | .06 | (3.5) | — | — | None |
| C | 2.67 | 0.9 t | — | — | .02 | (1) | — | — | None |
| A | 3.83 | 1.4 t | .7 t | 1.7 t | .05 | (3) | .02 | (1.4) | None |
| B | 3.89 | 1.6 t | — | — | .06 | (3.5) | — | — | None |
| A | 5.08 | 1.3 t | 1.2 t | 1.9 t | .05 | (3) | .03 | (1.9) | None |
| B | 4.83 | 1.6 t | — | — | .05 | (3.5) | — | — | None |
| C | 4.88 | .8 t | — | — | .02 | (1) | — | — | None |

NOTE:
*Minimum bend radii expressed in terms of metal thickness

EXAMPLE VI

The impact resistance of the alloy used in the invention was tested for various gauges and under various quench conditions. Samples of the alloy, as described in example V, were tested using a 305 mm by 305 mm sheet bolted into a fixture with a bolt circle of 254 mm diameter and an unsupported area of 203 mm diameter. A wedge punch 50 mm long with a 3 mm striking radius was employed. Each sample was statically loaded with the punch and the maximum load recorded. Each of the samples was solution heat treated at 466° C. followed by either a cold water quench (CWQ) of a forced air quench (FAQ) at various rates. Each sample was then aged for 2 hours at 121° C. Samples A–D were then given a second aging step consisting of 8 hours at 160° C. while samples E–G were given a second aging step of 4 hours at 177° C. Samples H–J represented a control alloy, (AA) 7146-T63 which was solution heat treated at 400° C., quenched with FAQ at a rate of 2.4° C./sec and aged for 3 hours at 121° C. and 3 hours at 148° C. The composition of this alloy is shown in table 3. The results shown in table 10 indicate superior properties compared to the control for the water quenched samples made using the alloy of the invention and comparable results when an air quench rate of at least 2.9° C./sec was used.

TABLE 10

RELATIVE CRACKING PERFORMANCE OF HIGH STRENGTH ALLOY SHEET IN WEDGE TEST

| Sample | Thickness mm | Average Cracking Load For Unit Thickness kN/(mm)$^{4/3}$ | | Relative Cracking Performance | Quench |
|---|---|---|---|---|---|
| A | 2.60 | 4.72 | | 1.06 | CWQ |
| B | 2.59 | 4.20 | | 0.94 | FAQ (3.7° C./sec) |
| C | 4.28 | 4.98 | | 1.11 | CWQ |
| D | 4.27 | 4.16 | | 0.93 | FAQ (2.9° C./sec) |
| E | 3.92 | 3.75 | | 0.84 | FAQ (2.4° C./sec) |
| F | 3.71 | 4.42 | | 0.99 | FAQ (3.4° C./sec) |
| G | 3.75 | 5.30 | | 1.19 | CWQ |
| H (Control) | 5.05 | 4.26 | average = | | FAQ (2.4° C./sec) |
| I (Control) | 2.54 | 4.65 | 4.47 | 1.00 | FAQ (2.4° C./sec) |
| J (Control) | 2.54 | 4.49 | | | FAQ (2.4° C./sec) |

NOTE:
CWQ = Cold Water Quench
FAQ = Forced Air Quench

Thus the invention provides an improved aluminum article constructed from a novel aluminum base alloy characterized by a yield strength of over 414 MPa (60 ksi) and good corrosion resistance when aged to a T76 temper, good formability in an annealed state, and sufficiently low quench sensitivity to permit air quenching.

Having thus described the invention, what is claimed is:

1. A shaped aluminum article heat treated, air quenched at a rate of from 3.5 to 5° C. per second, and then aged to a T76 temper by aging said heat treated and quenched article for from 1½ to 3 hours at a temperature of 120° C. plus or minus 6° C. followed by a second aging step of from 4 to 12 hours at a temperature of 160° C. plur or minus 6° C. to 177° C. plus or minus 3° C. and characterized by a high transverse yield strength after said aging of at least 414 MPa (60 ksi) and further characterized by good resistance to corrosion and low quench sensitivity comprising an aluminum base alloy consisting essentially of 6.5 to 7.5 wt. % zinc, 2.4 to 3.0 wt. % magnesium, 0.0 to 0.8 wt. % copper, and 0.01 to 0.18 wt. % zirconium with the balance consisting essentially of aluminum.

2. The shaped aluminum article of claim 1 wherein said article is solution heat treated, after forming, for a period of from 5 to 20 minutes at a temperature of from 400° to 495° C.

3. The shaped aluminum article of claim 2 wherein said solution heat treated article is quenched in air at a rate of from 3.5° to 5° C. per second down to 260° C. to achieve sufficient strength and corrosion resistance without distorting said article.

4. The shaped aluminum article of claim 3 wherein said aging to a T76 temper comprises aging the heat treated and air quenched article for from 1½ to 3 hours at a temperature of 120° C.±6° C. followed by a second aging step for from 6 to 12 hours at a temperature of from 160° to 177° C.±6° C.

5. The shaped aluminum article of claim 4 wherein the alloy further contains chromium in an amount not exceed-ing 0.05 wt. %.

6. The shaped aluminum article of claim 5 wherein the alloy further contains other alloying ingredients and/or impurities as follows: 0.2 wt. % silicon, 0.4 wt. % iron, 0.1 wt. % manganese, 0.06 wt. % titanium, and 0.05 wt. % each other alloying ingredient and/or impurity.

7. The shaped aluminum article of claim 6 wherein the maximum of said other alloying ingredients and/or impurities does not exceed a total of 0.15 wt. %.

8. A shaped aluminum article formed using an aluminum base alloy characterized by a high yield strength of over 414 MPa (60 ksi) and good corrosion resistance after solution heat treatment of the article at a temperature of 425° to 495° C. for at least 8 minutes, followed by forced air quenching down to 260° C. at a rate of from 3.5° to 5° C. per second and then aging to a T76 temper; good formability in an annealed state; and low quench sensitivity permitting said air quenching to minimize distortion of said article; said aluminum alloy consisting essentially of: 6.5 to 7.5 wt. % zinc, 2.4 to 3.0 wt. % magnesium, 0.0 to 0.4 wt. % copper, and 0.08 to 0.18 wt. % zirconium, with the following maximum amounts of other alloying ingredients or impurities: 0.2 wt. % silicon, 0.4 wt. % iron, 0.1 wt. % manganese, 0.05 wt. % chromium, 0.06 wt. % titanium, and 0.05 wt. % maximum each other alloying ingredient or impurity with a total maximum of 0.15 wt. %; the balance consisting essentially of aluminum.

9. The shaped aluminum article of claim 8 wherein said aging to a T76 temper is carried out for 1½ to 3 hours at a temperature of about 120° C. in a first step and for 6 to 12 hours at a temperature of from about 160° to 177° C. in a second aging step.

10. A process for forming a shaped aluminum article characterized by a yield strength of over 414 MPa (60 ksi) and good resistance to corrosion which comprises:

(a) providing an aluminum base alloy consisting essentially of 6.5 to 7.5 wt. % zinc, 2.4 to 3.0 wt. % magnesium, 0.0 to 0.8 wt. % copper. 0.01 to 0.18 wt. % zirconium, and a maximum of other alloying ingredients and/or impurities not exceeding 0.15 wt. % with each of said other alloying ingredients and/or impurities not exceeding 0.5 wt. % with the balance consisting essentially of aluminum;
(b) forming a shaped article from said alloy;
(c) solution heat treating said shaped article;
(d) quenching said heat treated article in air; and
(e) aging said heat treated and air quenched article to a T76 temper.

11. The process of claim 10 wherein said shaped article is heat treated for a period of from 5 to 20 minutes at a temperature of from 400° to 495° C.

12. The process of claim 10 wherein said shaped article is air quenched after said solution heat treatment at a rate of from 3.5° to 5° C. per second down to 260° C. to achieve sufficient strength and resistance to exfoliation without distorting said shaped article.

13. The process of claim 10 wherein said shaped article is aged for from 1½ to 3 hours at 120° C.±6° C.

followed by a second aging step of from 6 to 12 hours at from 160° to 177° C. ±6° C.

14. The shaped alloy of claim 1 wherein the copper content of said aluminum base alloy is from 0.0 to 0.4 wt. %.

15. The process of claim 11 wherein the step of providing an aluminum base alloy further comprises providing an aluminum base alloy having a copper content of from 0.0 to 0.4 wt. %.

16. A process for forming a shaped aluminum article characterized by a high yield strength of over 414 MPa (60 ksi) and good corrosion resistance which comprises:

(a) providing an aluminum alloy consisting essentially of: 6.5 to 7.5 wt. % zinc, 2.4 to 3.0 wt. % magnesium, 0.0 to 0.8 wt. % copper, 0.08 to 0.18 wt. % zirconium, and a maximum of other alloying ingredients and/or impurities as follows: 0.2 wt. % silicon, 0.4 wt. % iron, 0.1 wt. % manganese, 0.05 wt. % chromium, 0.06 wt. % titanium, and 0.05 wt. % each of other alloying ingredients or impurities with a maximum of other alloying ingredients or impurities not exceeding 0.15 wt. %; the balance consisting essentially of aluminum;

(b) forming a shaped article from said alloy;

(c) solution heat treatment said shaped article at a temperature of 425° to 495° C. for at least 8 minutes;

(d) air quenching said heat treated shaped article down to 260° C. at a rate of from 3.5° to 5° C. per second to avoid distorting said shaped article; and (e) aging said quenched article for from 1½ to 3 hours at 120° C.±6° C. followed by a second aging step of from 6 to 12 hours at from 160° to 177° C. ±6° C. to achieve a T76 temper;

whereby said resultant product will be characterized by high yield strength, good resistance to exfoliation and stress corrosion cracking, and minimum distortion of the shaped product.

* * * * *